United States Patent [19]

Bergenwall

[11] Patent Number: 4,637,652

[45] Date of Patent: Jan. 20, 1987

[54] PIECE OF FURNITURE

[75] Inventor: Henning Bergenwall, Sandviken, Sweden

[73] Assignee: Mölnlycke Konsumentprodukter AB, Mölnlycke, Sweden

[21] Appl. No.: 772,138

[22] Filed: Sep. 3, 1985

[51] Int. Cl.[4] ..... A47C 1/02

[52] U.S. Cl. ..... 297/90; 297/330; 297/DIG. 10

[58] Field of Search ..... 297/DIG. 10, 90, 330, 297/75, 340

[56] References Cited

U.S. PATENT DOCUMENTS

| | | | |
|---|---|---|---|
| 2,289,733 | 7/1942 | Rust | 297/90 |
| 2,564,083 | 8/1951 | Stechert | 297/90 X |
| 2,808,827 | 10/1957 | O'Hara | 297/90 X |
| 3,964,786 | 6/1976 | Mashuda | 297/DIG. 10 |
| 4,231,614 | 11/1980 | Shaffer | 297/330 |
| 4,249,774 | 2/1981 | Andreasson | 297/330 |

FOREIGN PATENT DOCUMENTS

| | | | |
|---|---|---|---|
| 869404 | 3/1953 | Fed. Rep. of Germany | 297/90 |

*Primary Examiner*—Francis K. Zugel

*Attorney, Agent, or Firm*—McAulay, Fields, Fisher, Goldstein & Nissen

[57] ABSTRACT

A piece of furniture comprises a stand, a seat and a back support pivotable with respect to the seat as well as an upwardly and downwardly pivotable leg support which is provided with a foot-rest, at least one operating means being arranged to, at pivoting of the back support backwardly from a sitting position, in which the feet of the user are resting on the foot-rest, and a simultaneous pivoting of the leg support upwardly and forwardly, cause such a relative movement between the foot-rest and the seat that the knee-adjacent leg portions of the user remain in supporting contact with the supporting areas of the piece of furniture. The operating means is also adapted to, at the pivoting of the leg support upwardly and forwardly, cause a movement of the seat in the direction backwardly relative to the stand and thereby relative to the pivot axis of the leg support.

16 Claims, 5 Drawing Figures

9
19
30
31
23
24
32
8
2
13
7
20
21
12
29
11
14
6
1
18
27
15
35
28
10
5
10
16
17
25
33
34
26
3
4
22

PIECE OF FURNITURE

FIELD OF THE INVENTION AND PRIOR ART

This invention relates to a piece of furniture according to the preamble of the appended claim 1.

Such a piece of furniture is already known through Ser. No. 366 645. In the piece of furniture described therein, the knee-adjacent leg portions of the person sitting in the piece of furniture remain, at a pivoting of the back support and the leg/foot-rest from a lying to a sitting position or convertedly, in contact with the supporting areas formed by the leg/foot-rest and the seat. This is made possible although the pivoting center between the thigh-bone and the shank of the person, viz the knee joint, is located at a distance above the pivoting center of the leg/foot-rest, since the leg/foot-rest is prolonged at the pivoting upwardly. In this piece of furniture the pivoting axis of the leg support is rigidly connected to the seat. This leads to the serious disadvantage that the back portion of the person will, at the pivoting backwardly of the back support relative to the seat, as a consequence of being the hip-joint of the person located far above the hinge between the seat and the back support, slide downwards the back support, since the person is pivoted about this hip-joint and his seat portion remains in an undisplaced position on the seat of the piece of furniture. This sliding is unpleasant and can besides displacing of clothes lead to injuries under unfavourable circumstances. Furthermore, since the leg/foot-rest is prolonged at the pivoting into lying position, the piece of furniture cannot directly be pivoted from the lying position into the standing position, because in trying to do so this rest will hit against the floor.

SUMMARY OF THE INVENTION

This invention is based on the realization of the disadvantages mentioned above and the object of the invention is to reduce the disadvantages and accordingly increase the comfort of the piece of furniture.

In accordance with the invention this object is achieved by providing a piece of furniture of the type discussed above with the characteristics defined in the appended claim 1.

In this piece of furniture the displacing of the seat backwardly relative to the stand brings about that the thigh-bone and seat portions of the user come closer to the back support and thereby the user will, at the simultaneous pivoting backwardly of the back support, not slide downwards along the back support. Moreover, it is possible to bring the person lying on the piece of furniture according to the invention directly into the standing position, since the leg/foot-rest shows a constant length.

BRIEF DESCRIPTION OF THE DRAWINGS

With reference to the appended drawings, below follows a specific description of an embodiment according to the invention.

In the drawings.

DETAILED DESCRIPTION OF A PREFERRED EMBODIMENT

Figure 1:
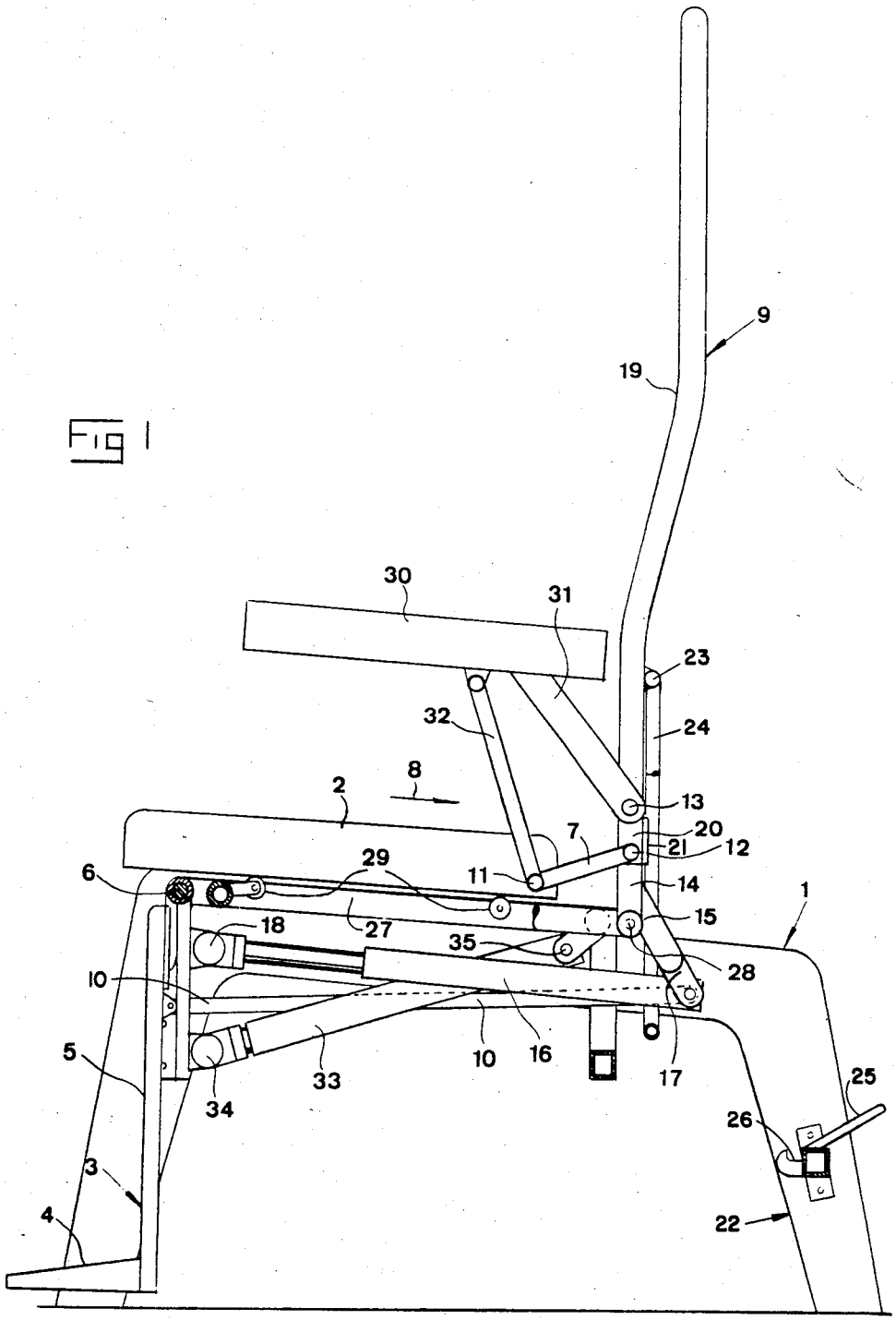
FIG. 1 is a schematic, partly sectioned side elevation of the piece of furniture according to the invention in the sitting position.

The piece of furniture illustrated in the drawings will below be called "a chair" since it, despite that it permits a lying position, primarily has the function of a piece of furniture for sitting. However, the piece of furniture could as well be designed with the primary purpose to act as a piece of furniture for lying.

The chair has a stand 1, a seat 2 and an upwardly and downwardly pivotable support 3, designed for the legs and/or feet of the user. In this example, this support comprises a substantially horizontal portion 4 supporting the feet in the normal sitting position and a substantially vertical portion 5 supporting the shanks in said position. The support 3 is pivotably arranged relative to the stand 1 about a horizontal axis 6, in such a way that the support 3 can be pivoted upwardly into a position (see for example FIG. 3) in which the portion 4 is substantially vertical and the portion 5 substantially horizontal.

The seat is movably arranged in the direction forwardly/backwardly relative to the stand of the chair and connected to operating means 7 arranged to, in pivoting the support 3 upwardly, cause a movement of the seat 2 in the direction backwardly (see arrow 8, FIG. 1).

The chair comprises a pivotable back support 9, which is connected to the support 3 with a link 10 pivotably connected to the back support 9 and the support 3, in such a manner that a pivoting of the back support backwardly gives rise to a pivoting of the support 3 upwardly, while the pivoting of the back support forwardly causes a pivoting of the support 3 downwardly. In this example, the operating means 7 comprise two links arranged at the sides of the chair, which are pivotably connected to the rear edge of the seat at points 11 and to the back support 9 at points 12. The two links are arranged in parallel.

The back support 9 is about a hinge 13 pivotably connected to an intermediate part 14, which is connected to means (e.g. a bearing sleeve 15) for obtaining the pivotability of the back support. The links 7 are pivotably connected to the back support 9 at said points 12.

A power means 16 for causing pivoting of the back support 9 is acting on the intermediate part 14 as a result of that it at one end is pivotably connected to a fastener 17, which is rigidly attached to the intermediate part 14. The power means is of the type varying its length and the second end of it is connected to the stand at a point 18. The back support is connected to the intermediate part 14 by the hinge 13, so that the back support shows two portions 19, 20 extending outwardly from the hinge in opposite directions. The one portion 19 extends, when the back support is pivoted into a normal sitting position, upwardly and is constituting the real back supporting part of the back support. The other portion 20 is on the other hand substantially shorter and extends downwardly. In the example, the portion 20 of the back support is provided with means in the form of a plate 21 for limiting the pivoting of the portion 19 of the back support backwardly relative to the intermediate part 14. Such a stop means could also be arranged on the intermediate part 14 or the intermediate part as well as the back support. In practice the hinges 13 of the intermediate part relative to the back support are arranged in the side regions of the chair.

The links 7 are connected to the outer end of the second portion 20 of the back support. The first portion 19 of the back support is adapted to, at the pivoting of the back support backwardly, enter into supporting engagement with a portion 22 of the stand in such a way, that continued influence by the power means 16 on the intermediate part 14 for the purpose of pivoting the intermediate part in the direction backwardly gives rise to pivoting of the back support 9 relative to the intermediate part 14 so that the first portion 19 of the back support is pivoted upwardly. The second portion 20 of the back support will preferably also move backwardly and in the example also downwardly, so that the seat 2 by the links 7 is pulled backwardly in spite of the back support 9 not being additionally pivoted backwardly. More exactly, the first portion 19 of the back support is through a hinge 23 connected to a rigid support 24, which is intended to enter into engagement with the support portion 22 of the stand. The support portion 22 can be provided with a guiding surface 25, which is so located that the support 24, which as a result of the attraction of gravity is positioned into the vertical position, at the backward movement of the back support automatically will come into contact with said guiding surface 25 and through the inclination of this automatically be brought to a seat 16.

The seat 2 is carried by a seat frame 27. This seat frame is pivotably connected to the stand about an axis which in the example co-incides with the pivoting axis 6 of the support 3. The back support 9 is pivotably connected to the seat frame 7 via the intermediate part 14. The hinge between the intermediate part and the seat frame is indicated by 28. The seat frame has rollers 29 or other similar means, which engage with the under side of the seat 2 and have as an object to provide for low friction displacement of the same in a substantially horizontal plane possible.

Elbow-rests 30 are arranged on the sides of the chair. Each of these elbow-rests is fastened to a first carrying means 31, which is connected to the hinge 13 joining the back support 9 and the intermediate part 14 together. The elbow-rest 30 is also pivotably connected to a second carrying means 32, which in its turn is pivotably connected to the seat 2 at the connecting point 11 of the link 7. Through proper location of the connections of the carrying means to the elbow-rest and the points 11 and 13 one achieves at the movements of the seat and the back support a movement of the elbow-rest suitable for good comfort. More exactly, the elbow-rest is in the normal sitting position according to FIG. 1 entering into a position with essentially 90° angle relative to the back support 9. At the pivoting of the back support backwardly the elbow-rest will also be pivoted backwardly, but to a lower degree than the back support.

Figure 5:
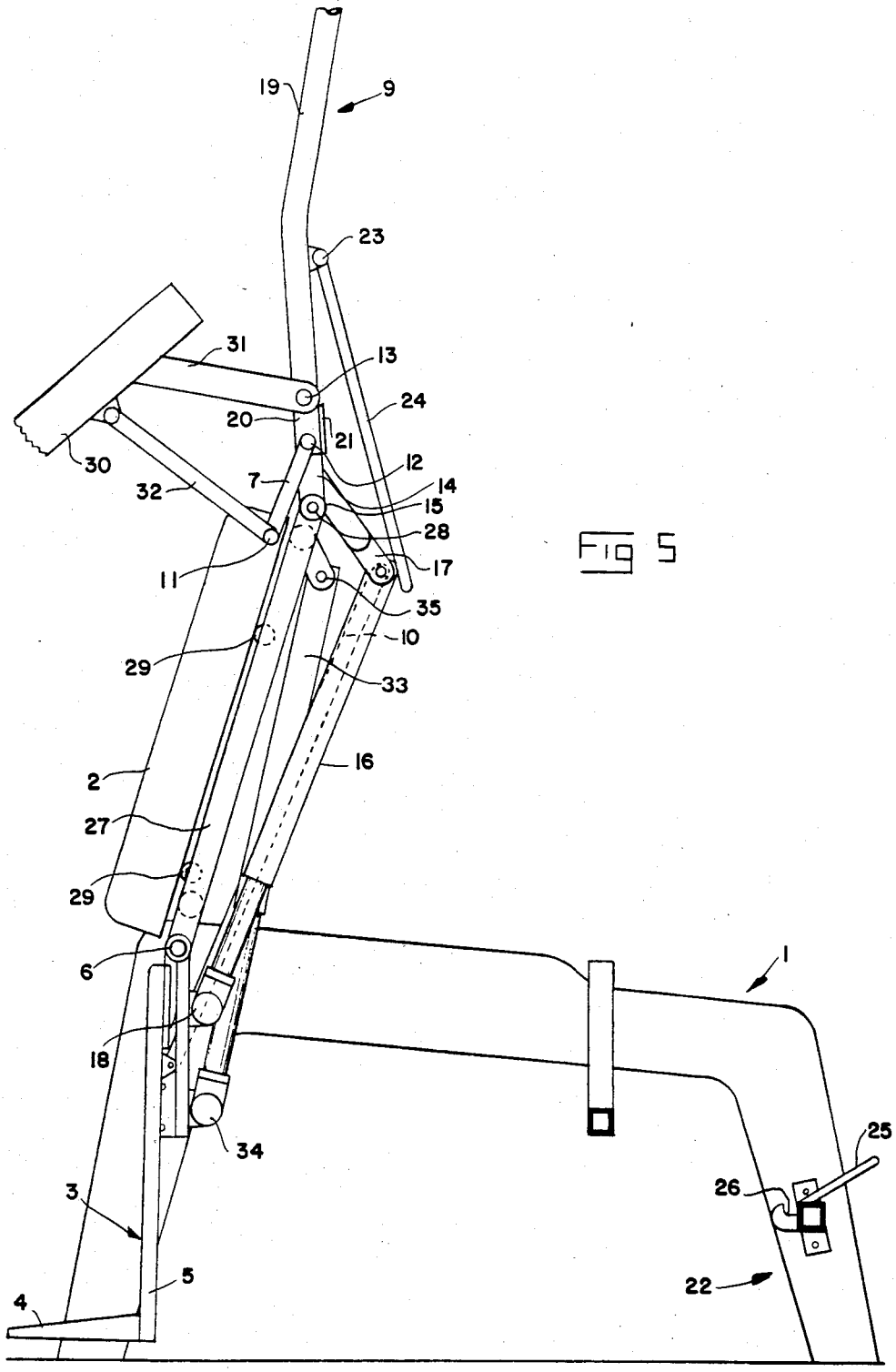
FIG. 5 is a view of the piece of furniture adjusted into a position, in which a person is brought to upright standing or in which a standing person can be received in the piece of furniture.

The link 10 is in the example also connected to the fastener 17. A second power means 33 with variable length is at 34 pivotably connected to the stand and at 35 to the seat frame 27 so that the chair can be brought into the position illustrated in FIG. 5.

Figure 2:
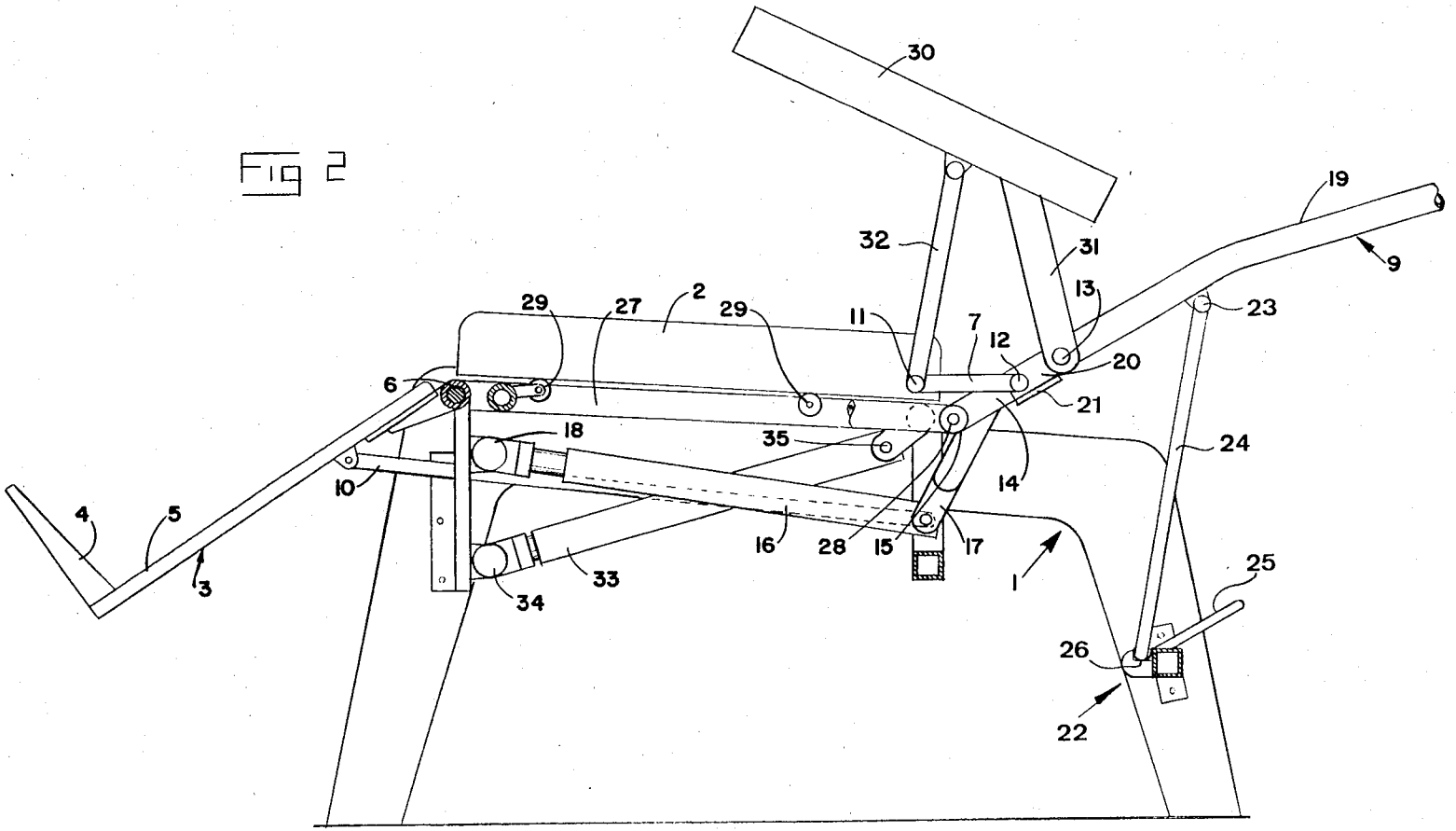
FIG. 2 is a view similar to FIG. 1 of the piece of furniture in the lying position.
Figure 3:
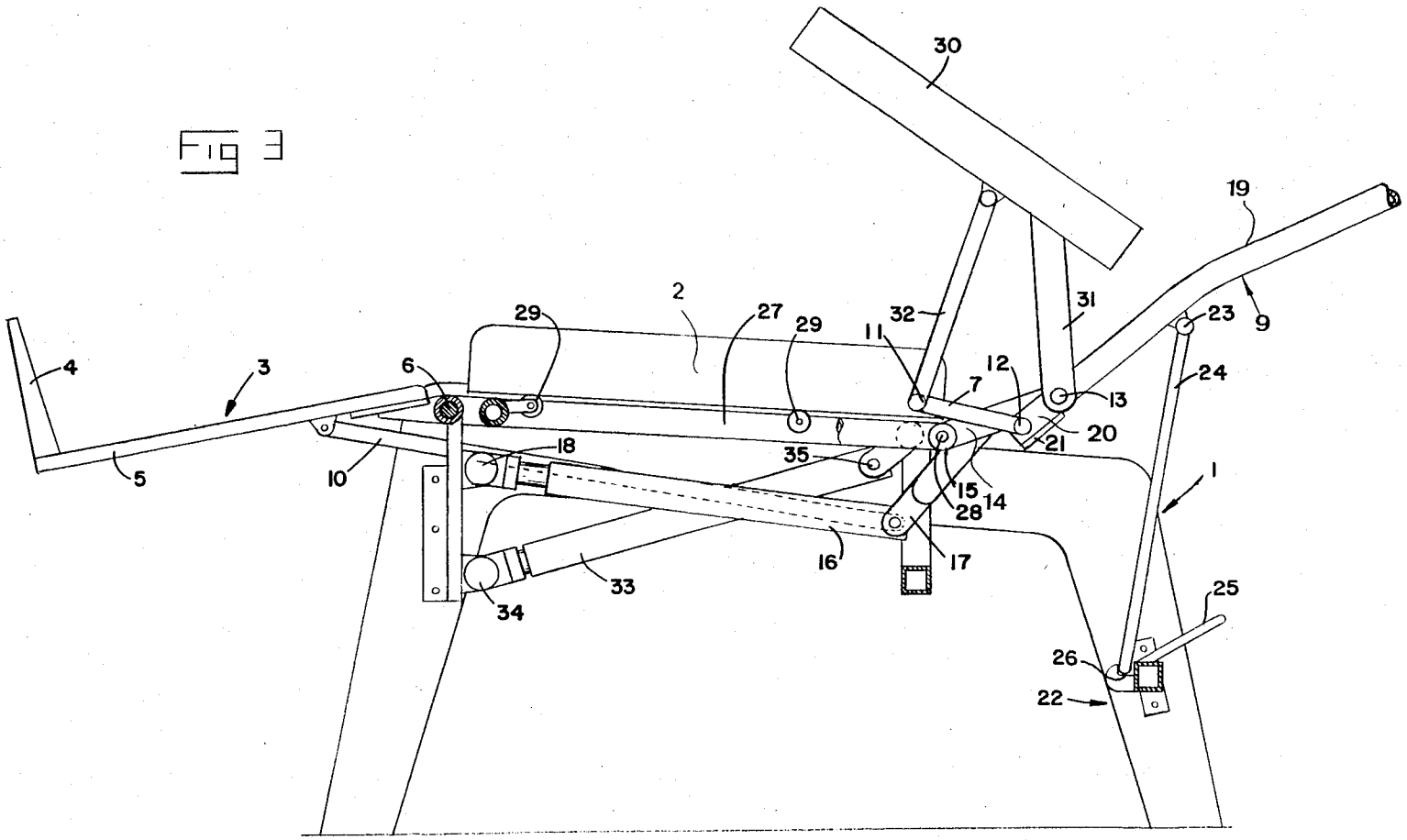
FIGS. 3 and 4 are views relatively similar in character to FIG. 2 but illustrating the piece of furniture in somewhat varying positions.
Figure 4:
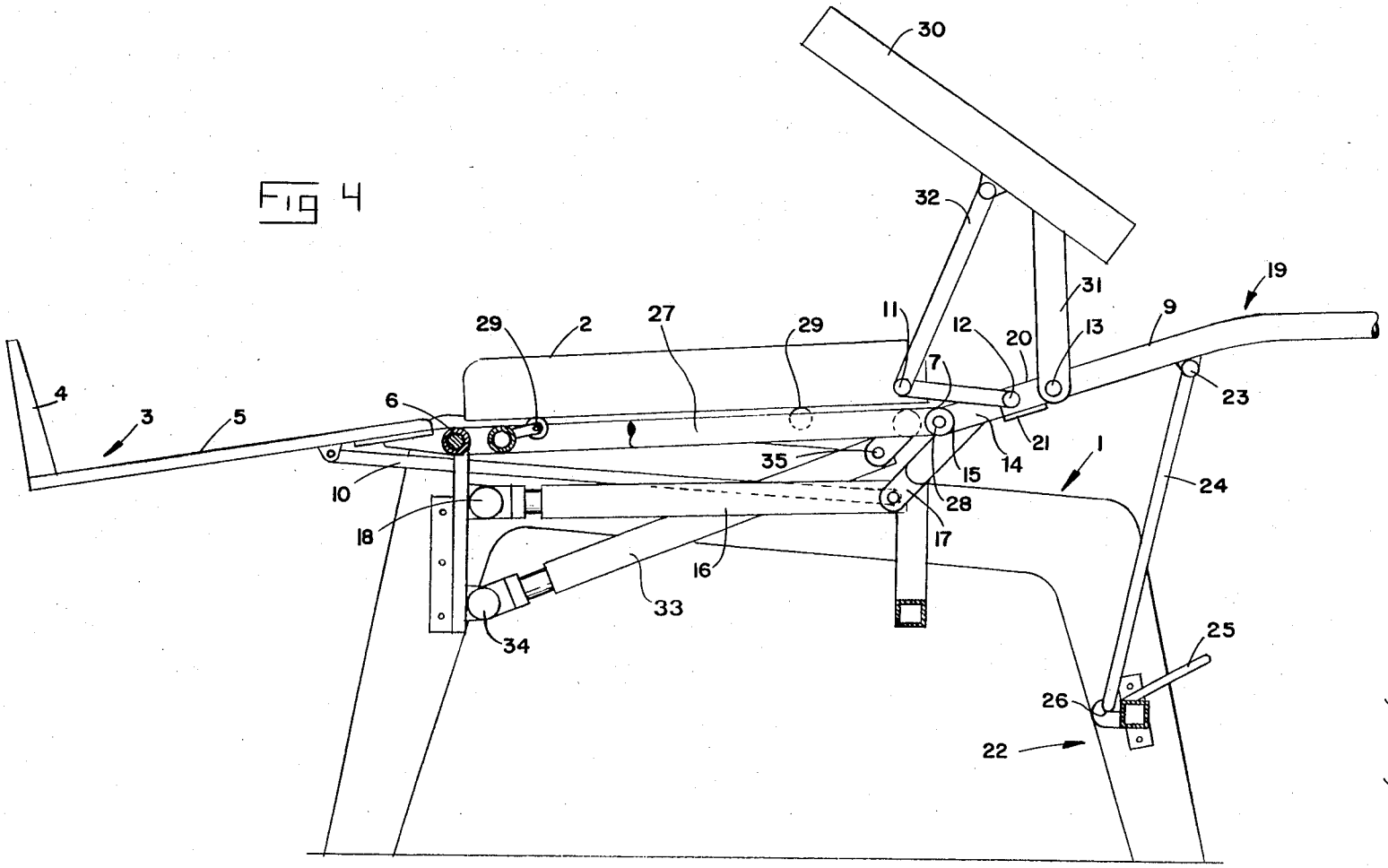

In using the chair one can change from the position according to FIG. 1 into the position according to FIG. 2 by contraction of the power means 16. During this movement the pivoting of the back support 9 backwardly gives through the links 7 rise to a displacement of the seat 2 backwardly. At the same time the support 3 is by means of the link 10 pivoted upwardly. Further, during the movement the back support 9 and the intermediate part 14 are moved together without relative pivoting movement. However, when the position according to FIG. 2 is reached the support 24 has entered into contact with the support surface 25 and been moved to the seat 26. Continued contraction of the power means 16 will thereby forcibly lead to pivoting of the intermediate part 14 backwardly, but the back support 9 will in return pivot about the support point 23 so that the portion 19 of the back support is moving upwardly at the same time as the portion 20 is moving downwardly. By means of the links 7 this will give rise to an additional backward displacement of the seat 2 at the same time as the support 3 is additionally pivoted upwardly through the link 10 so that accordingly the position according to FIG. 3 is obtained. If a person lying in the chair would like to be brought into a standing position according to FIG. 5, he can by means of control equipment (not shown) cause prolongation of the power means 33 so that as a result of that the seat frame 27 is pivoted upwardly/forwardly relative to the stand 1 (see FIG. 4). During this movement the power means 16 is locked against length variation. The pivoting of the seat frame 27 upwardly causes a relative pivoting between this frame and the intermediate part 14 and also between this frame and the back support 9 until the time when the position according to FIG. 4 is reached. The stop means 21 prevent the back support 9 to pivot further backwardly relative to the intermediate part 14 so that when the support 24 of the back support is leaving the seat 26 at continued pivoting of the seat frame 27 upwardly the components 24, 14 and 9 will not, during the continued pivoting upwardly into the position according to FIG. 5, in substance change their relative positions. In a downward sinking from the position according to FIG. 5 in the direction of the position according to FIG. 4 the support 24 will end up in the seat 26. This leads to that the last part of the pivoting of the seat frame 27 downwardly gives rise to a pivoting of the portion 19 of the back support upwardly, which has turned out to increase the feeling of security of the user.

The seat 2 is in the figures by its thickness indicated to be provided with stuffing, which for the sake of clarity has been omitted for the back support 9. Such stuffing can also be added to the portion 5 of the support 3.

The piece of furniture can naturally be modified in several ways within the scope of the invention.

I claim:

1. A piece of furniture, comprising:

a stand a seat, a back support pivotable with respect to said seat, and an upwardly and downwardly pivotable leg support provided with a foot-rest;

at least one operating means pivotably connected with said seat and said support for movement thereof backwardly from a sitting position, in which the feet of a user are resting on said foot-rest, and for a simultaneous pivoting of said leg support upwardly and forwardly to cause a relative movement between said foot-rest and said seat such that knee-adjacent leg portions of the user remain in supporting contact with the supporting areas of the piece of furniture;

said seat being movably arranged in a direction forwardly and backwardly relative said stand through pivoting of said back support;

said leg support being pivotably connected to said stand about a pivot axis fixed with respect to said stand for all movements relative to said stand, said foot-rest being located at a constant distance from said pivot axis during the pivoting of said leg support upwardly and downwardly;

said operating means upon pivoting of said leg support upwardly and forwardly imparting movement of the seat in a direction backwardly relative to said stand and thereby relative to said pivot axis of said leg support, and said operating means comprising at least one link extending between a point on said seat and a point on said back support;

an intermediate part having a first part pivotally hinged through a front hinge to said seat and a second part pivotally hinged through a second hinge to said back support for pivoting of said back support;

power means associated with said intermediate part through said seat for pivoting said support in response to said seat imparting movement to said intermediate part;

said back support having first and second portions, said first portion being connected to said intermediate part about said second hinge so that said first portion extends outwardly from said second hinge, and when said back support is from said second hinge, and when said back support is pivoted to a normal sitting position said first portion extends upwardly and substantially forms the real back supporting part of the back support, and said second portion extends downwardly;

means associated with at least one of said intermediate part and said back support for limiting the pivoting of said first portion of said back support backwardly relative to said intermediate part; and said link being to said second portion of said back support, wherein said first portion of said back support is arranged to, at the backward pivoting of said back support, enter into supporting engagement with a portion of said stand in such a way that continued influence by said power means on said intermediate part for pivoting thereof in the direction backwardly gives rise to pivoting of said back support relative to said intermediate part so that said first portion of said back support is pivoted upwardly and so that said second portion of said back support is moved at least one of backwardly and downwardly and thereby via said link actuates the seat in the backward direction.

2. A piece of furniture according to claim 1, wherein the first portion of the back support is pivotably attached to a support intended to enter into engagement with the stand.

3. A piece of furniture according to claim 1, wherein the seat is movably carried by a seat frame, which in its turn is pivotable relative to the stand and to which the back support is pivotably connected by means of the intermediate part.

4. A piece of furniture according to claim 3, wherein an elbow-rest is attached to a first carrying means, which is pivotably connected to the intermediate part, and wherein the elbow-rest also is pivotably connected to a second carrying means, which in its turn is pivotably connected to the seat.

5. A piece of furniture acoording to claim 3, including an elbow-rest attached to a first carrying means, said first carrying means being pivotably connected to said back support, said elbow-rest being pivotably connected to a second carrying means, which in its turn is pivotably connected to said seat.

6. A piece of furniture according to claim 3, wherein said first portion of said back support is pivotably attached to a support for entering into engagement with said stand.

7. A piece of furniture according to claim 4, wherein said portion of said back support is pivotably attached to a support for entering into engagement with said stand.

8. A piece of furniture according to claim 2, wherein said seat is movably carried by a seat frame, which in its turn is pivotable relative to said stand and to which said back support is pivotably connected by means of said intermediate part.

9. A piece of furniture according to claim 1, including an elbow-rest attached to a first carrying means, said first carrying means being pivotably connected to said intermediate part, and said elbow-rest also being pivotably connected to a second carrying means, which in its turn is pivotably connected to said seat.

10. A piece of furniture according to claim 1, including an elbow-rest attached to a first carrying means, said first carrying means being pivotably connected to said back support, said elbow-rest pivotably connected to a second carrying means, which in its turn is pivotably connected to said seat.

11. A piece of furniture according to claim 2, including an elbow-rest attached to a first carrying means, said first carrying means being pivotably connected to said back support, said elbow-rest being pivotably connected to a second carrying means, which in its turn is pivotably connected to said seat.

12. A piece of furniture according to claim 2, including an elbow-rest attached to a first carrying means, said first carrying means being pivotably connected to said intermediate part, and said elbow-rest also being pivotably connected to a second carrying means, which in its turn is pivotably connected to said seat.

13. A piece of furniture, comprising:

a stand, a seat, a back support pivotable with respect to said seat, and an upwardly and downwardly pivotable leg support provided with a foot-rest;

at least one operating means pivotably connected with said seat and said support for movement thereof backwardly from a sitting position, in which the feet of a user are resting on said foot-rest, and for a simultaneous pivoting of said leg support upwardly and forwardly to cause a relative movement between said foot-rest and said seat such that knee-adjacent leg portions of the user remain in supporting contact with the supporting areas of the piece of furniture;

said seat being movably arranged in a direction forwardly and backwardly relative to said stand through pivoting of said back support;

said leg support being pivotably connected to said stand about a pivot axis fixed with respect to said stand for all movements relative to said stand, said foot-rest being located at a constant distance from said pivot axis during the pivoting of said leg support upwardly and downwardly;

said operating means upon pivoting of said leg support upwardly and forwardly imparting movement of the seat in a direction backwardly relative to said stand and thereby relative to said pivot axis of said leg support, and said operating means comprising at least one link extending between a point on said seat and a point on said back support;

an intermediate part being about a hinge connected to the back support, means for obtaining the pivotability of the back support being connected to the intermediate part;

power means for attending to the pivoting of the back support acting on the intermediate part;

said back support having first and second portions, said first portion being connected to said intermediate part about said hinge so that said first portion extends outwardly from said hinge, and when said back support is pivoted to a normal sitting position said first portion extends upwardly and substantially forms the real back supporting part of the back support, and said second portion extends downwardly; and means associated with at least one of said intermediate part and said back support for limiting the pivoting of said first portion of said back support backwardly relative to said intermediate part, said link being pivotably connected to the second portion of the back support, wherein said first portion of said back support is arranged to, at the backward pivoting of said back support, enter into supporting engagement with a portion of said stand in such a way that continued influence by said power means on said intermediate part for pivoting thereof in the direction backwardly gives rise to pivoting of said back support relative to said intermediate part so that said first portion of said back support is pivoted upwardly and so that said second portion of said back support is moved at least one of backwardly and downwardly and thereby via said link actuates the seat in the backward direction.

14. A piece of furniture according to claim 13, wherein the first portion of the back support is pivotably attached to a support intended to enter into engagement with the stand.

15. A piece of furniture according to claim 13, wherein the seat is movably carried by a seat frame, which in its turn is pivotable relative to the stand and to which the back support is pivotably connected by means of the intermediate part.

16. A piece of furniture according to claim 15, wherein an elbow-rest is attached to a first carrying means, which is pivotably connected to the back support of the intermediate part, and wherein the elbow-rest also is pivotably connected to a second carrying means, which in its turn is pivotably connected to the seat.

* * * * *